US011611179B2

(12) United States Patent
Grünewald et al.

(10) Patent No.: US 11,611,179 B2
(45) Date of Patent: Mar. 21, 2023

(54) CONNECTION DEVICE

(71) Applicant: MTS SENSOR TECHNOLOGIE GMBH & CO. KG, Lüdenscheid (DE)

(72) Inventors: Florian Grünewald, Olpe (DE); Hubert Koschnik, Lüdenscheid (DE); Thomas Schmale, Meinerzhagen (DE)

(73) Assignee: TEMPOSONICS GMBH & CO. KG, Ludenscheid (DE)

( * ) Notice: Subject to any disclaimer, the term of this patent is extended or adjusted under 35 U.S.C. 154(b) by 69 days.

(21) Appl. No.: 17/225,017

(22) Filed: Apr. 7, 2021

(65) Prior Publication Data

US 2021/0320463 A1 Oct. 14, 2021

(30) Foreign Application Priority Data

Apr. 8, 2020 (DE) ..... 102020109786.7

(51) Int. Cl.

| | |
|---|---|
| ***H01R 13/60*** | (2006.01) |
| ***H01R 13/73*** | (2006.01) |
| ***F15B 15/08*** | (2006.01) |
| ***H01R 13/50*** | (2006.01) |
| ***H01R 13/52*** | (2006.01) |

(52) U.S. Cl.

CPC ..... *H01R 13/73* (2013.01); *F15B 15/08* (2013.01); *H01R 13/50* (2013.01); *H01R 13/5202* (2013.01)

(58) Field of Classification Search

CPC .... H01R 13/50; H01R 13/5202; H01R 13/73; F15B 15/08

USPC ..... 439/569

See application file for complete search history.

(56) References Cited

U.S. PATENT DOCUMENTS

| | | | | |
|---|---|---|---|---|
| 3,483,789 A | | 12/1969 | Wurzel | |
| 3,732,527 A | * | 5/1973 | McKnight | H01R 13/56 439/446 |
| 4,073,514 A | | 2/1978 | Pate | |
| 4,078,298 A | | 3/1978 | Hurst | |

(Continued)

FOREIGN PATENT DOCUMENTS

| | | |
|---|---|---|
| DE | 202006018568 U1 | 4/2007 |
| DE | 202019101084 U1 | 3/2019 |

OTHER PUBLICATIONS

Example of push-in fixes available before Mar. 19, 2018.

*Primary Examiner* — Abdullah A Riyami
*Assistant Examiner* — Vladimir Imas
(74) *Attorney, Agent, or Firm* — Steven M. Koehler; Westman, Champlin & Koehler, P.A.

(57) ABSTRACT

A connection device for connecting an electrical or electronic component, which is accommodated in a thick-walled housing part, through a stepped bore in the wall of the housing part, includes a connection part having a stepped cylindrical body having a first cylindrical portion with a first outer diameter corresponding to the diameter of an inner bore portion of the stepped bore and a second cylindrical portion with a second outer diameter corresponding to the larger diameter of an outer bore portion, and a separate, essentially cylindrical contact carrier part fixed in the base body, which has contact pins protruding from an inner end face located on the inside of the thick-walled housing part. A fastener detachably fastens the connection part inserted in the stepped bore in the bore of the housing part.

14 Claims, 3 Drawing Sheets

(56) References Cited

U.S. PATENT DOCUMENTS

| | | | | |
|---|---|---|---|---|
| 4,454,381 | A * | 6/1984 | Ito | H02G 3/088 174/650 |
| 5,603,530 | A | 2/1997 | Guest | |
| 6,113,429 | A | 9/2000 | Weigel | |
| 6,244,892 | B1 * | 6/2001 | McCarthy | H01R 4/5025 439/421 |
| 6,948,971 | B2 * | 9/2005 | Bartholoma | H01R 13/506 439/462 |
| 6,986,680 | B2 * | 1/2006 | Wu | F21V 21/02 439/551 |
| 7,552,803 | B2 * | 6/2009 | Luce | B64C 25/60 188/269 |
| 8,695,764 | B2 * | 4/2014 | Luce | B64C 25/60 188/269 |
| 8,853,537 | B2 * | 10/2014 | Kempeneers | H02G 15/013 174/77 R |
| 8,876,552 | B2 * | 11/2014 | Taguchi | H01R 13/501 439/582 |
| 9,450,393 | B2 | 9/2016 | Thompson et al. | |
| 9,699,927 | B2 * | 7/2017 | Takahashi | H05K 5/0247 |
| 10,622,762 | B1 * | 4/2020 | McKee | H01R 13/506 |
| 10,727,630 | B2 | 7/2020 | Schmale | |
| 10,916,877 | B1 * | 2/2021 | Khazen | H01R 13/65915 |
| 11,043,781 | B2 * | 6/2021 | Watkins | H01R 4/50 |
| 2004/0053525 | A1 * | 3/2004 | Matsuo | H01R 13/5202 439/142 |
| 2020/0091665 | A1 * | 3/2020 | Maki | H01R 12/7082 |
| 2021/0066857 | A1 * | 3/2021 | Gilkey | H01R 12/724 |
| 2021/0257770 | A1 * | 8/2021 | Martin | H01R 13/50 |
| 2021/0273368 | A1 * | 9/2021 | Yuan | H01R 43/18 |

* cited by examiner

CONNECTION DEVICE

BACKGROUND

The invention relates to a connection device for connecting an electrical or electronic component, which is accommodated in a thick-walled housing part, through a stepped hole in the wall of the housing part. It further relates to a tool for mounting the connection device and finally to a hydraulic cylinder of a hydraulic system in which the proposed cable connection system is used. The invention further relates to a method of manufacturing such a hydraulic cylinder.

Connection devices and cable connection systems of a similar type are known and used in practice. For prior art in printed form, reference is made to U.S. Pat. Nos. 4,454,381, 7,552,803 B2 and 8,695,764 B2.

Currently, cable glands are mainly used for sealing and strain relief of connecting cables of electrical devices installed in enclosures. Cable glands that comply with IP69 are expensive and have the disadvantage that plastics such as cable sheathing shrink or creep and thus become leaky over a period of time. In addition, cable glands can be improperly tightened, which can damage plastic and sealing parts, which also leads to malfunctions.

Systems with cable glands also have the serious disadvantage that although a seal or protection class of up to IP 69 can be achieved by means of annular compression of a rubber or elastomer ring, the sheath of the connection cable is also strongly constricted at the sealing point. Since the material of the sheath, often PVC (polyvinyl chloride) or PUR (polyurethane) plastic, 'flows away' over time from the force of the constriction, leaks inevitably occur over time.

In another commercially available system, a connecting part with which the connecting cable is guided through the wall of the housing part is provided with a square mounting plate which has a hole at each corner, each for receiving a fastening screw for screwing the connecting part to the housing part.

In addition to the hole for receiving a cylindrical body of the feed-through, four additional threaded holes are required for mounting this connection device, and four screws must be screwed into the connection device and the housing part for assembly. This solution therefore requires a considerable amount of work and time.

From U.S. Ser. No. 10/727,630 of the applicant, an improved connection device is known, which makes it possible to install a connection plug in a thick wall or housing in a simple and safe manner, without screws, threads or adhesives.

It has been shown that even with this substantially improved connection device, certain problems can occur in practice, in particular fretting corrosion between the parts of the plug-in connection used there and corrosion as a result of residual moisture in the cylinder bore and/or moisture entering it from outside.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background.

Aspects of the invention include a further improved connection device which, in particular, offers greater corrosion resistance and is also easier to assemble if possible. Furthermore, a method for manufacturing a hydraulic cylinder, wherein such an improved connection device is used, is disclosed.

On the device side, an aspect of the invention includes the idea of forming the connection part of the connection device from two separate parts, namely a base body and a separately manufactured contact carrier part which can be fixed in the base body and which carries contact pins which project in particular from the inner end face of the contact carrier part. On the one hand, this makes it easier to assemble the connection device and, on the other hand, at least in special designs, it largely avoids the fretting corrosion that could occur with the known connection part.

From the current point of view, a preferred design of the connection between the base body and the contact carrier part provides that in the first section of the base body of the connection part and on the contact carrier part, corresponding latches are arranged to form a latching connection between the base body and the contact carrier part.

In a further preferred embodiment, a potting compound element encasing the contact pins is provided on the inner end face of the contact carrier part. In an expedient embodiment thereof, the contact carrier part is trough-shaped and the trough is filled with the potting compound element. This design offers significantly improved corrosion resistance by preventing the penetration of residual moisture from the cylinder bore of a hydraulic cylinder and/or moisture coming from outside the cylinder to the critical electrical contacts to the greatest possible extent.

In another preferred embodiment, the contact pins in the contact carrier part are of the Deusch-DT04 compatible contact type. Alternatively, contact carriers or contact pins configured according to the TE AMPSeal 16 or AMP Superseal standard, each as a 4-pole variant, can be used.

In a further preferred embodiment, a sealing lip or sealing ring is provided on the outer circumference of the first section of the base body and on or near the inner end face of the contact carrier part. This contributes to a further improved moisture tightness of the connection device and thus a further improved corrosion resistance of the component connection.

In a further preferred embodiment, which enables the connection device to be fitted in the bore of the thick-walled housing part (especially hydraulic cylinder) in a particularly simple and cost-effective manner, the fastener for fixing the connection part in the bore comprise a fixing disc with an opening configured to the outer edges of the plug part for threading the plug part through and an outer contour, especially a crown disc, configured to the inner diameter of the outer bore section and shaped to lock the fixing disc in the outer bore section.

A hydraulic cylinder provided with the connection device specifically has an embedded electrical or electronic assembly, in particular a position sensor assembly, and a connection device of the above type for external connection of the assembly, wherein a stepped bore is provided in the wall of the head part of the hydraulic cylinder with an inner bore section with a first diameter and an outer bore section with a second diameter which is larger than the first diameter, and the connection part of the connection device is fixed in the stepped bore.

From a process point of view, an aspect of the invention includes the idea of first connecting only the contact carrier part to the electrical or electronic component which is to be mounted in the housing part (especially the hydraulic cylinder) and of then inserting the two connected members into the housing part while, at the same time, guiding the contact carrier part with the strands connected to it out of the stepped bore in the wall. Only then is the connection part assembled by placing the base body on the contact carrier part and fixing the contact carrier part in the base body. Afterwards, the connection part mounted in this way is returned to the hole in a manner known per se, and is fixed there.

In preferred embodiments of this method, potting of the corrosion-critical contact pins or connection areas with the connected strands with potting compound and/or sealing of the connection part to the outside and inside with separately provided and inserted sealing rings can take place. The latter step can of course be omitted if the base body and the contact carrier part are each provided with moulded-on sealing lips.

BRIEF DESCRIPTION OF THE DRAWINGS

Advantages and usefulness of the invention will also be apparent from the following description of an example of an embodiment based on the figures, where.

DETAILED DESCRIPTION OF THE ILLUSTRATIVE EMBODIMENT

FIGS. 1A-1D show on the one hand a base body 1 of the connection device. The base body 1 has a first base body section 1*a* with a first outer diameter and an adjoining second cylindrical (disc-shaped) base body section 1*b* with a second, larger outer diameter. A plug part 2 of a standardised design projects from the second, disc-shaped base body section 1*b* of the base body 1 and comprises a plug housing 2*a* made preferably of a thermoplastic material. The plug housing 2*a* is in particular integrally molded onto the base body 1.

A circumferential annular groove 1*c* in the lower base body section 1*a* serves to receive an outer sealing ring 4*a*, which is used to seal the base body 1 in a bore of a housing part where it is mounted (cf. FIGS. 2 and 2A and the description below).

Furthermore, these figures show a separate contact carrier part 3, which together with the base body 1 forms the connection part. The contact carrier part 3 is essentially cylindrical, with an outer diameter such that it can be slid into the first base body section 1*a* of the base body. In the assembled state of the connector, the contact carrier part 3 is inserted into the base body 1 to such an extent that its upper end face is at the level of the disc-shaped second base body section 1*b* of the base body.

Four longitudinal slots 3*a* in the contact carrier part separate its wall over most of its height into four separate wall sections. Of these, two opposite ones each have an annular projection 3*b* of triangular cross-section running parallel to the end face of the contact carrier part. When the contact carrier part 3 is inserted into the base body 1, the annular extensions 3*b* slide along the inner wall of the base body 1 and finally spring into an annular groove (not shown) with a corresponding cross-section provided in a suitable position there. This locks the contact carrier part 3 into the base body 1 and thus fixes it. A circumferential annular groove 3*c* on the circumference of the contact carrier part 3 serves to receive an inner sealing ring 4*b*, which seals the contact carrier part 3 from the base body 1 in the assembled state.

In the version shown, the contact carrier part 3 carries four contact pins 3*d* in a standardised version, in this case the so-called German-DT04 version, which in the assembled state project through corresponding holes in the end face of the contact carrier part 3 into the plug part 2. A flexible, bendable conductor (a contact strand) 5 is soldered or crimped to the free (lower left in FIG. 1A) ends of the contact pins 3*d*.

Figure 1A:
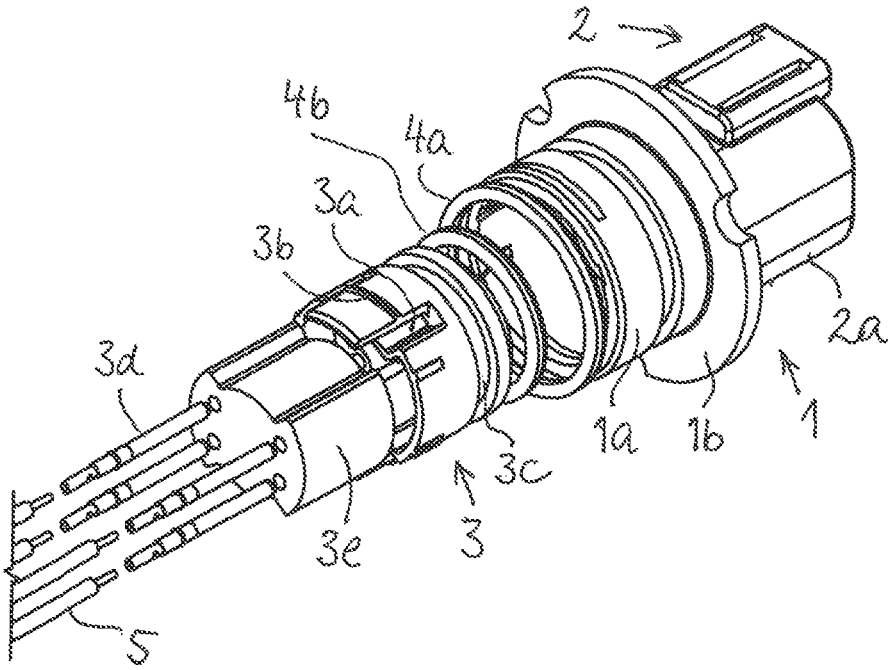
FIGS. 1A-1D are two perspective views and a front and side view of an embodiment of the connection part of the connection device.
Figure 1B:
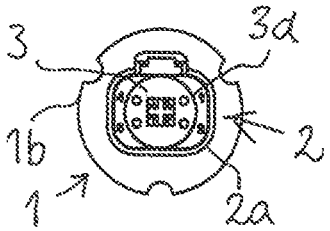
Figure 1C:
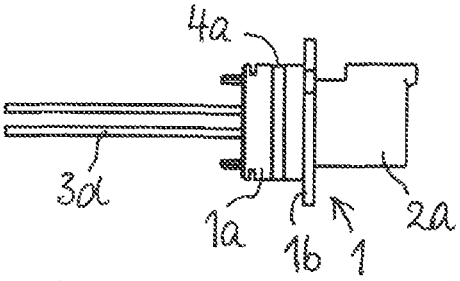
Figure 1D:
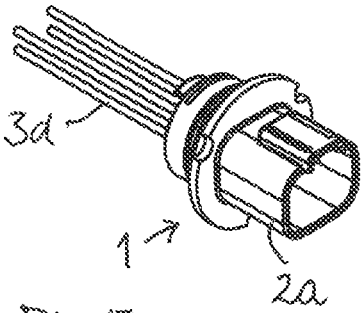

FIG. 1A also shows (symbolically as a separate part) a potting compound element 3*e*, which is formed after insertion of the plug pins 3*d* into the contact carrier part 3 by potting the interior of the contact carrier part 3 with a potting compound which fills the interior of the contact carrier part 3 and sealingly encloses the contacts.

Figure 3:
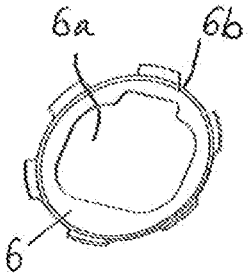
FIG. 3 is a perspective view of an exemplary fastening means of the connection device.

FIG. 3 shows a crown washer 6 which serves as a fastener of the connector device. The crown washer 6 has a circular central opening 6*a*, the inner contour of which is adapted to the cross-sectional shape (outer contour) of the connector part 2, and a toothed outer circumference 6*b*, which is configured to the outer diameter of the second cylindrical section 1*b* of the basic body 1 (and thus at the same time to the diameter of a bore mentioned further below) in such a way that the crown washer 6 locks into the said bore when appropriate force is applied (see also further below).

The semi-circular recesses in the circumferential edge of the first base body section 1*b* of the base body 1 (FIG. 1A) (not described separately) serve to implement another type of fastening of the connection device. In this other type of fastening, fastening screws engage in these recesses and are used to screw the connection device into the thick-walled housing part. Here, the screw heads rest half on the first base body section 1*b* and half on the surrounding housing wall.

Figure 2:
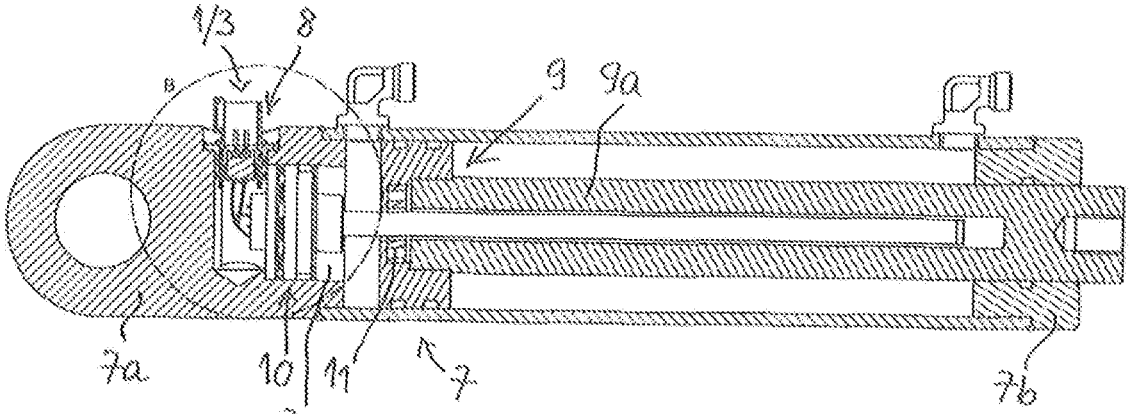
FIG. 2 is a longitudinal sectional view of a hydraulic cylinder in which a connection device with a connection part according to FIG. 1A—1D is installed.

FIG. 2 shows in a longitudinal sectional view a general view of a hydraulic cylinder 7 as a version of a thick-walled housing part in which the connection device is inserted. The hydraulic cylinder 7 has a cylinder base 7*a* and a cylinder closure 7*b*, through which a piston rod 9*a* of a hydraulic piston 9 passes centrally. Near the cylinder base 7*a*, a stepped bore 8 is formed in the wall of the hydraulic cylinder 7, which has an inner section 8*a* with a smaller diameter and an outer section 8*b* with a larger diameter.

A position sensor assembly 10 is used to determine the position of the hydraulic piston 9 with respect to the hydraulic cylinder 7 and for this purpose cooperates with a position magnet 11 which is inserted in the piston rod 9*a*. The exact construction and function of the position sensor assembly 10 and the position magnet 11 are not relevant to the explanation of the present invention and are therefore not described here. It should be mentioned, however, that connection strands 5 are led out of the position sensor assembly 10, the ends of which (as already mentioned above) lead to the ends of the contact pins in the contact carrier 3 of the connection part and are connected to these in a form-fitting and/or material-fitting manner.

Figure 2A:
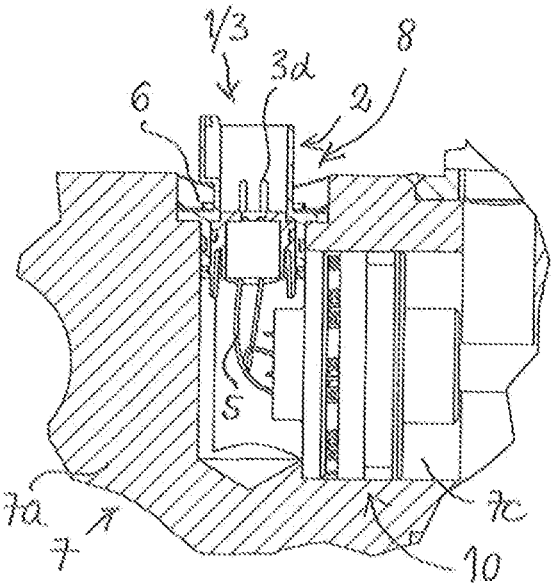
FIG. 2A is a detailed view of a portion of FIG. 2.

As can be seen in FIGS. 2 and 2A, the connecting part 1/3 is seated in the bore 8 of the hydraulic cylinder 7 in such a way that its first base body section 1*a* (see FIG. 1B) is seated in the inner section 8*a* of the bore 8 and the second base body section 1*b* is inserted in the outer bore section 8*b* and rests on the annular end face of the outer bore section. In this position, the connector is held in place by the engaged crown washer 6. The sealing ring 4*a*, which is seated in a groove in the first base body section 1*a*, seals the connecting part 1/3 in the inner bore section 8*a*.

FIGS. 4A-4D show the steps of manufacturing the connection device in a manner similar to the FIGS. 1A-3 explained above. In these figures, only a few reference numbers are inserted; with regard to the other parts/sections of the components shown, reference is made to FIGS. 1A-3 and the above explanations.

Before carrying out the process steps shown in the above figures and described further below, the above-mentioned radially stepped bore 8 is created in the peripheral wall of the hydraulic cylinder 7, at the end of a stepped axial bore 7*c* near the cylinder base 7*a*. Furthermore, the contact carrier part 3 is connected in advance with the already inserted contact pins 3*d* to the connection strands 5 of the position sensor assembly 10 and cast with the potting compound 3*e*.

Figure 4A:
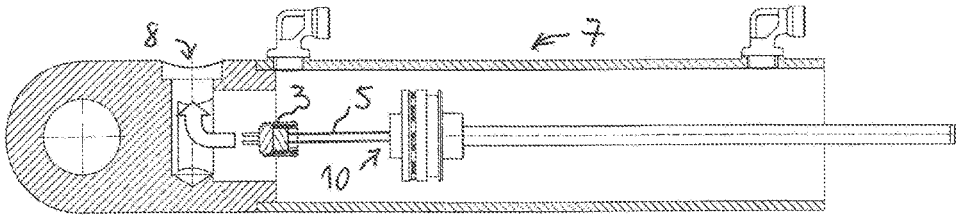
FIGS. 4A-4E are stages in the manufacture of the hydraulic cylinder according to FIG. 2.
Figure 4B:
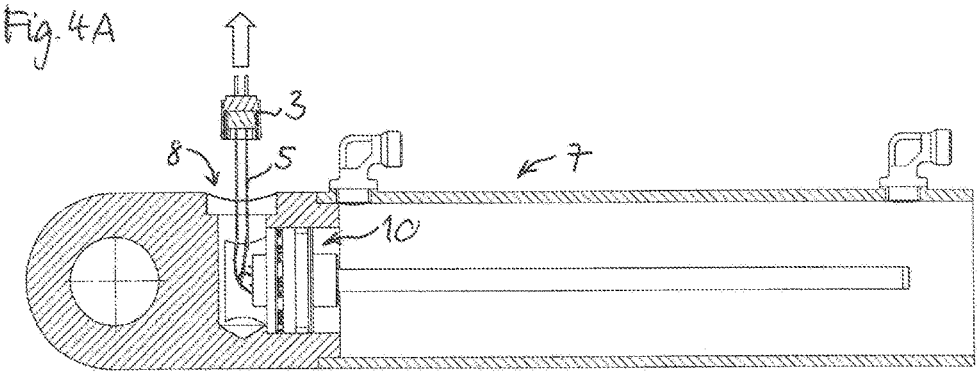

FIGS. 4A and 4B show how the position sensor assembly 10, with lead wires 5 soldered thereto, is axially aligned with and inserted centrally into the hydraulic cylinder 7. FIG. 4B shows that the position sensor assembly 10 has arrived at its destination on the cylinder base 7*a* of the hydraulic cylinder 7, where it is seated in the further section of the stepped axial bore 7*c* that is adapted to its external shape. During insertion, at the same time, the connection strands 5 with the contact carrier part 3 are guided outwards through the stepped radial bore 8 through the wall of the cylinder base.

Figure 4C:
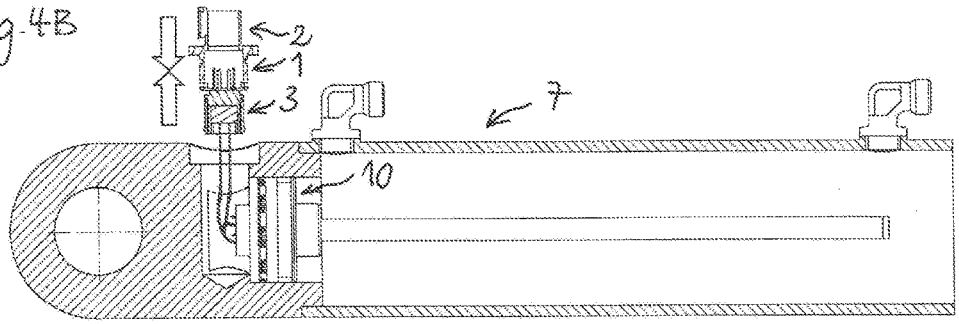
Figure 4D:
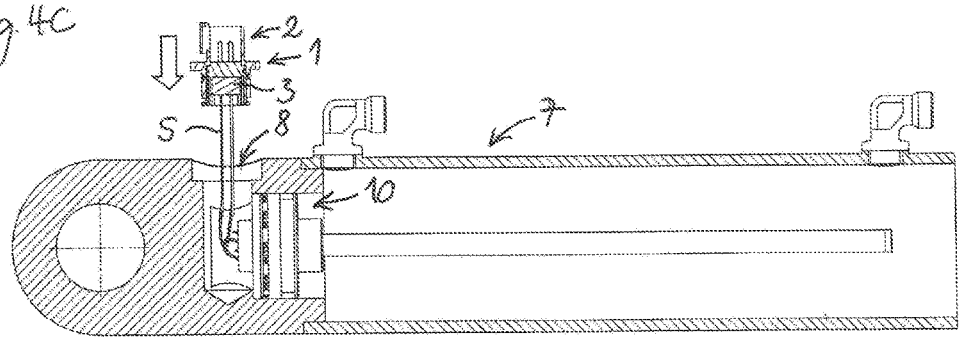
Figure 4E:
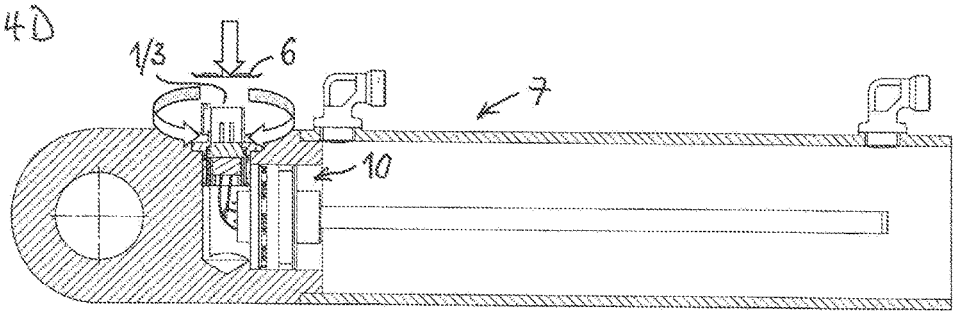

FIGS. 4C and 4D show that the base body 1 with the plug section 2 is placed on the contact carrier part 3 guided through the bore 8 to the outside of the hydraulic cylinder 7 in such a way that the components of the connection part engage in each other and are then positively connected. FIG. 4E shows how the fully assembled connection part 1/3 is inserted into the hole 8. The curved arrows P1, P2 in FIG. 4E show that the connection part 1 is largely free to rotate in the bore 8 and can be brought into a desired angular position in the outer wall of the hydraulic cylinder 7.

The connecting part 1/3 is then fixed in the bore 8 using the crown washer shown in FIG. 3 in the manner described in U.S. Ser. No. 10/727,630, which is herein incorporated by reference in its entirety. The final state of the hydraulic cylinder with mounted connection device is shown in FIG. 3.

Although the subject matter has been described in language directed to specific environments, structural features and/or methodological acts, it is to be understood that the subject matter defined in the appended claims is not limited to the environments, specific features or acts described above as has been held by the courts. Rather, the environments, specific features and acts described above are disclosed as example forms of implementing the claims.

What is claimed is:

1. A connection device for connecting an electrical or electronic component, which is accommodated in a thick-walled housing part, through a stepped bore of a wall of the housing part, comprising:

a connection part with a stepped cylindrical base body having a first cylindrical portion with a first outer diameter corresponding to a diameter of an inner bore portion of the stepped bore and a second cylindrical portion with a second outer diameter corresponding to a larger diameter of an outer bore portion, and a separate, essentially cylindrical contact carrier part fixed in the base body, which has contact pins protruding from an inner end face located on an inside of the thick-walled housing part, and a fastener configured to detachably fasten the connection part inserted in the stepped bore of the housing part.

2. The connection device according to claim 1, wherein in the first cylindrical portion of the base body of the connection part and on the contact carrier part corresponding latches are configured to form a latching connection between the base body and the contact carrier part.

3. The connection device according to claim 1, wherein a potting compound part encasing the contact pins is provided on the inner end face of the contact carrier part.

4. The connection device according to claim 3, wherein the inner end face of the contact carrier part is designed in a shape of a trough and the trough is filled with the potting compound part.

5. The connection device according to claim 1, wherein the contact pins in the contact carrier part are of a Deusch-DT04-compatible contact type.

6. The connection device according to claim 1, wherein a sealing lip or a sealing ring is provided on an outer circumference of the first cylindrical portion of the base body and on or near the inner end face of the contact carrier part.

7. The connection device according to claim 1, wherein the fastener comprises a fixing disc with an opening configured to outer edges of the contact carrier part.

8. The connection device according to claim 7 wherein the fixing disc comprises a crown disc configured to an inner diameter of the outer bore section portion and shaped for locking the crown disc in the outer bore portion.

9. A hydraulic cylinder of a hydraulic system comprising:

a housing part having outer walls wherein a stepped bore with an inner bore section with a first diameter and an outer bore section with a second diameter, which is larger than the first diameter, is provided in a wall of a head part of the hydraulic cylinder;

an electrical or electronic assembly disposed within the outer walls, and a connection device for external connection of the electrical or electronic assembly, the connection device comprising:

a connection part fixed in the stepped bore with a stepped cylindrical base body having a first cylindrical portion with a first outer diameter corresponding to the diameter of an inner bore portion of the stepped bore and a second cylindrical portion with a second outer diameter corresponding to a larger diameter of an outer bore portion, and a separate, essentially cylindrical contact carrier part fixed in the base body, which has contact pins protruding from an inner end face located on an inside of the housing part, and a fastener configured to detachably fasten the connection part inserted in the stepped bore in the bore of the housing part.

10. The hydraulic cylinder according to claim 9, wherein the electrical or electronic assembly comprises a position sensor assembly, which is connected to the contact carrier part via stranded wires which are crimped or soldered to the contact pins in the contact carrier part.

11. A method of manufacturing a hydraulic cylinder assembly, comprising:

providing a housing part of the hydraulic cylinder having outer walls wherein a stepped bore with an inner bore section with a first diameter and an outer bore section with a second diameter, which is larger than the first diameter, is provided in a wall of a head part of the hydraulic cylinder, providing an electrical or electronic assembly and a connection device for external connection of the electrical or electronic assembly, the connection device having a connection part with a stepped cylindrical base body part having a first cylindrical portion with a first outer diameter corresponding to the diameter of an inner bore portion of the stepped bore and a second cylindrical portion with a second outer diameter corresponding to a larger diameter of an outer bore section of the stepped bore, and a separate, essentially cylindrical contact carrier part fixed in the base body, which has contact pins protruding from an inner end face located on an inside of the housing part, and producing a stranded wire connection between the electrical or electronic assembly and the contact pins of the contact carrier part, inserting the contact carrier part and component connected via the stranded wire connection into the hydraulic cylinder from its open end to a base of the hydraulic cylinder, while simultaneously guiding the contact carrier part out through the stepped bore to an outside of the wall, placing the base body of the connection part on the contact carrier part and fix the contact carrier part in the base body to form an assembled connector, inserting the assembled connector from an outside of an outer wall of the hydraulic cylinder into the stepped bore until the second cylindrical portion is seated on an annular bottom of the outer bore section, and fastening the assembled connector in the stepped bore using a fastener.

12. The method according to claim 11, wherein after producing the stranded wire connection, potting of a connection area of the contact pins with wire strands is carried out with potting compound.

13. The method according to claim 11, wherein before producing a stranded connection, placing a sealing ring on the contact carrier part on or near an inner face thereof, and before placing the base body of the connection part on the contact carrier part, inserting a sealing ring on the annular bottom of the outer bore section is carried out.

14. The method according to claim 11, wherein fastening the assembled connector comprises as hammering a fastening washer over the second cylindrical portion of the base body into the outer bore section.

* * * * *